United States Patent [19]

Mulleman

[11] 3,967,787

[45] July 6, 1976

[54] WIRE WINDING APPARATUS

[75] Inventor: Carlos Mulleman, Kortrijk, Belgium

[73] Assignee: N.V. Bekaert S.A., Zwevegem, Belgium

[22] Filed: Nov. 5, 1974

[21] Appl. No.: 521,032

[52] U.S. Cl. ..... 242/25 R; 242/158.2; 242/158.4 R

[51] Int. Cl.[2] ..... B65H 54/28

[58] Field of Search ..... 242/25 R, 25 A, 158.4 R, 242/158 R, 158.2

[56] References Cited

UNITED STATES PATENTS

| | | | |
|---|---|---|---|
| 3,038,674 | 6/1962 | Wahl | 242/25 R |
| 3,097,815 | 7/1963 | Smith et al. | 242/158.4 R |
| 3,289,956 | 12/1966 | Sjogren | 242/25 R |
| 3,677,483 | 7/1972 | Henrich | 242/25 R |
| 3,876,167 | 4/1975 | Nittschalk et al. | 242/158.4 R |

*Primary Examiner*—Stanley N. Gilreath
*Attorney, Agent, or Firm*—Edward J. Brenner

[57] ABSTRACT

An improvement in a wire winding apparatus of the type which includes a means for supporting and winding a flanged spool, a wire guide arranged to traverse the wire back and forth lengthwise of the spool in use and two end sensors which are operative to automatically reverse the direction of the operation of the guide at the end of each traverse, which improvement comprises (1) means for automatically moving each end sensor away from the other end sensor by a first predetermined distance after every actuation of the first mentioned end sensor, (2) means for detecting an accumulation of the wire adjacent either end of the spool and (3) means for automatically moving the end of the sensor associated with the flange toward the other end sensor by a second predetermined distance which is greater than the aforesaid first distance when such an accumulation is detected.

6 Claims, 5 Drawing Figures

WIRE WINDING APPARATUS

BACKGROUND OF THE INVENTION

1. Field of the Invention

This invention relates to winding apparatus and, more particularly but not exclusively, is concerned with winding apparatus for winding wire.

2. Description of the Prior Art

One known type of wire winding apparatus includes means for supporting and rotating a flanged spool, a wire guide arranged to traverse the wire back and forth lengthwise of the spool in use, and two end sensors operative to automatically reverse the direction of operation of the guide at the end of each traverse. Such apparatus is that herein referred to as being "of the type described." The intention is that when the end sensors are correctly positioned the wire forms a substantially uniform winding between the flanges of the spool.

In practice it has been found that the distance between the flanges of different spools differs, and that the distance between the flanges of the same spool can vary due to, e.g., mishandling of the spool. Furthermore, it is not always possible to ensure that different spools are held in exactly the same position in the same apparatus. Because of these factors one spool may be satisfactorily wound with the end sensors in one position while another spool has an accumulation or deficiency of wire (as hereinafter explained) adjacent one or both flanges with the end sensors in exactly the same position.

In an effort to achieve consistently uniform windings, apparatus has been constructed which includes means which detect accumulations or deficiencies of wire adjacent the flanges of a spool. If an accumulation is detected adjacent one flange a servo-motor is actuated to move the end sensor associated with that flange toward the other end sensor by a fixed distance, thereby decreasing the traverse of the wire guide. If a deficiency is detected adjacent one flange the servo-motor is actuated to move the end sensor associated with that flange away from the other end sensor by the same fixed amount.

Different means have been employed for detecting an accumulation or deficiency of wire. One such means directly detects an accumulation or a deficiency by sensing the angle between two arms carrying respective rollers which run on the surface of the wire on the spool, one adjacent a flange and the other some distance from it. Another such means indirectly detects an accumulation or a deficiency by sensing, e.g., photoelectrically, a rise or a fall in the path of movement of the wire as it approaches each flange, or by sensing changes in the tension of the wire as it approaches the flange. However, none of these detecting means so far proposed has been able to deal satisfactorily with a situation that often arises in which both an accumulation and a deficiency of wire appear next to one another adjacent a flange. In such a situation an indirect detecting means may fail to detect, for example, a deficiency which appears immediately adjacent the flange and immediately outwardly of an accumulation, particularly if the associated end sensor is currently aligned with a point between the deficiency and the accumulation. Similarly a direct detecting means may, in the circumstances just mentioned, react to the deficiency whereas it would more advantageously have reacted to the accumulation.

SUMMARY OF THE INVENTION

According to the present invention there is provided a winding apparatus of the type described, including means for automatically moving each end sensor away from the other end sensor by a first distance between successive actuations of the first-mentioned end sensor, means for detecting an accumulation of wire adjacent either flange of the spool, and means for automatically moving the end sensor associated with said flange toward the other end sensor by a second distance which is greater than said first distance upon such an accumulation being detected.

In operation, such an apparatus provides a more positive control than has heretofore been the case by, in most circumstances, purposely creating successive accumulations adjacent each spool flange and then cancelling out each such accumulation when it reaches a certain magnitude.

Preferably the second distance is from 3 to 20 times greater than said first distance; more preferably it is from 5 to 10 times greater.

The distances moved by the end sensors are preferably controllable by feeding pulses of varied length to servo-motors connected to the end sensors. In such an arrangement, the movement of one end sensor away from the other is controlled by a short pulse and the movement of the one end sensor toward the other is controlled by a long pulse.

Movement of one end sensor away from the other end sensor is preferably arranged to commence shortly before the reversal of direction of the said guide by the said other end sensor.

The means for detecting an accumulation adjacent either flange may comprise a dancer pulley connected to a potentiometer. When the wire is fed onto the spool the tension therein suddenly increases if the wire is fed onto an accumulation. This tension causes the dancer pulley to dip sharply. This causes the potentiometer to transmit a pilot pulse which is fed to a signal generator in the form of a timer. On receipt of such pilot pulse, the signal generator transmits a pulse of predetermined length to a servo-motor which moves the end sensor associated with the accumulation toward the other end trip by a predetermined distance.

BRIEF DESCRIPTION OF THE DRAWINGS

One embodiment of winding apparatus in accordance with the invention will now be described by way of example and with reference to the accompanying drawings, in which.

DESCRIPTION OF THE PREFERRED EMBODIMENTS

Figure 1:
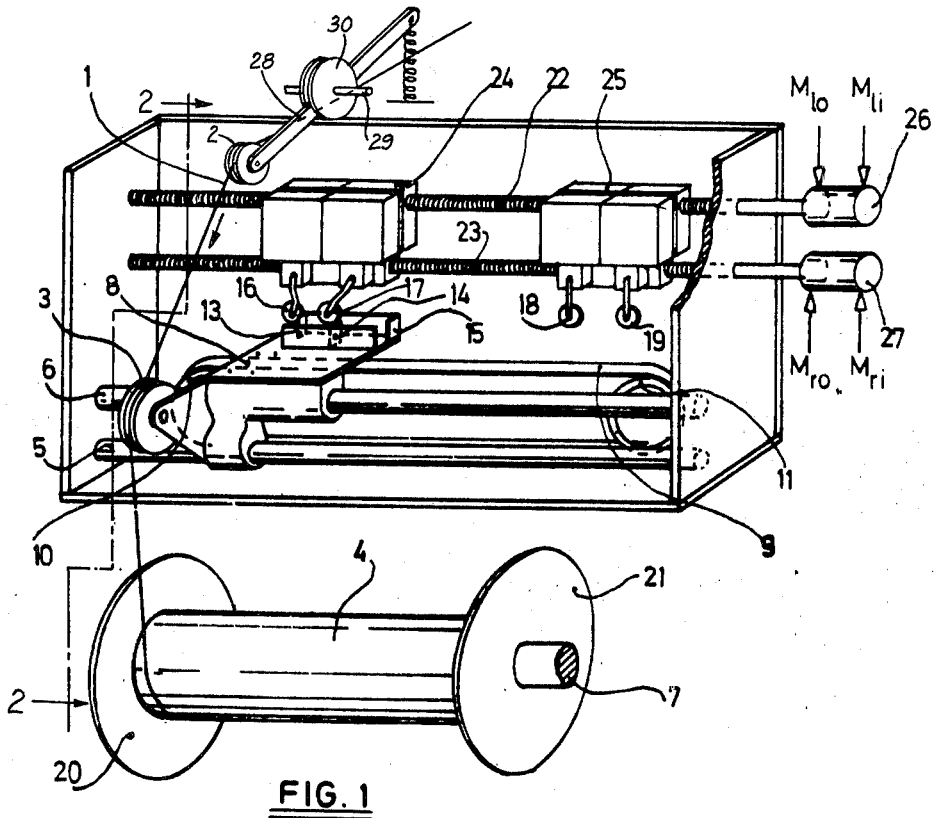
FIG. 1 is a schematic perspective view of the apparatus.
Figure 2:
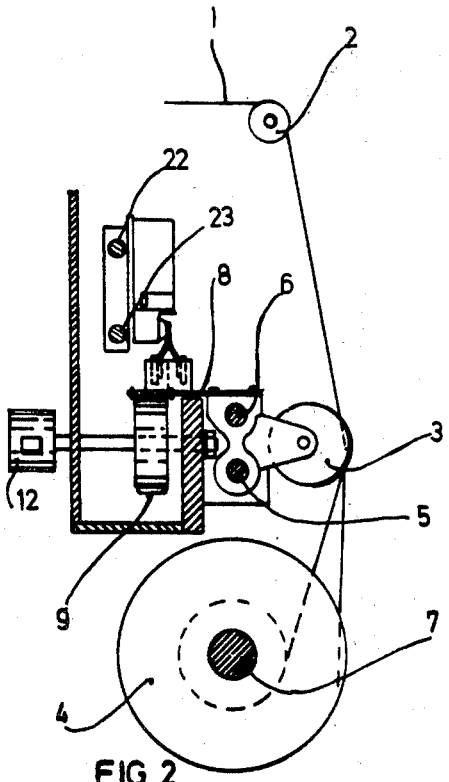
FIG. 2 is a section in the plane 2—2 of FIG. 1.

Referring to FIGS. 1 and 2 of the drawings, wire 1 is led from a wire drawing machine (not shown), over a dancer pulley 2 and a roller 3 onto a spool 4 which is fixed to a rotatable shaft 7. The roller 3 forms part of a guide which includes a platform 8. The guide, in use, traverses back and forth along bars 5 and 6 between two end sensors in the form of end trips 16 and 19. The platform 8 is connected to a belt 9 which passes over pulleys 10 and 11. Pulley 10 is connected to a reversible motor 12 which is connected to end trips 16 and 19 so that the direction of rotation of reversible motor 12 is reversed at the end of each traverse.

Three cam plates 13, 14 and 15 are mounted on platform 8. Cam plate 13 is positioned to actuate end trip 16 at the end of each leftward traverse and cam plate 15 is positioned to actuate end trip 19 at the end of each rightward traverse.

The end trips 16 and 19 are suspended from carriers 24 and 25 respectively. Threaded rods 22 and 23 pass through both carriers 24 and 25 and by rotating rod 22 carrier 24 can be moved and by rotating rod 23 carrier 25 can be moved. Servo-motor 26 is connected to rod 22 and servo-motor 27 is connected to rod 23. Trips 17 and 18 are suspended from carriers 24 and 25 respectively and are so connected with servo-motors 26 and 27 that when trip 18 is actuated a pulse of predetermined length is transmitted to servo-motor 26 whereby carrier 24 moves away from carrier 25 by a first predetermined distance. Similarly, when trip 17 is actuated by platform 8 a pulse of predetermined length is transmitted to servo-motor 27 whereby carrier 25 moves away from carrier 24 by the same predetermined distance.

Figure 3A:
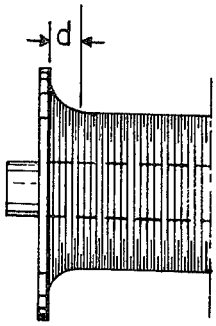
FIGS. 3*a* and 3*b* show respectively an accumulation and a deficiency of wire adjacent a flange of a spool.
Figure 3B:
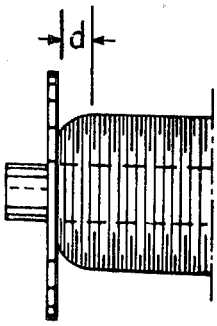
Figure 4:
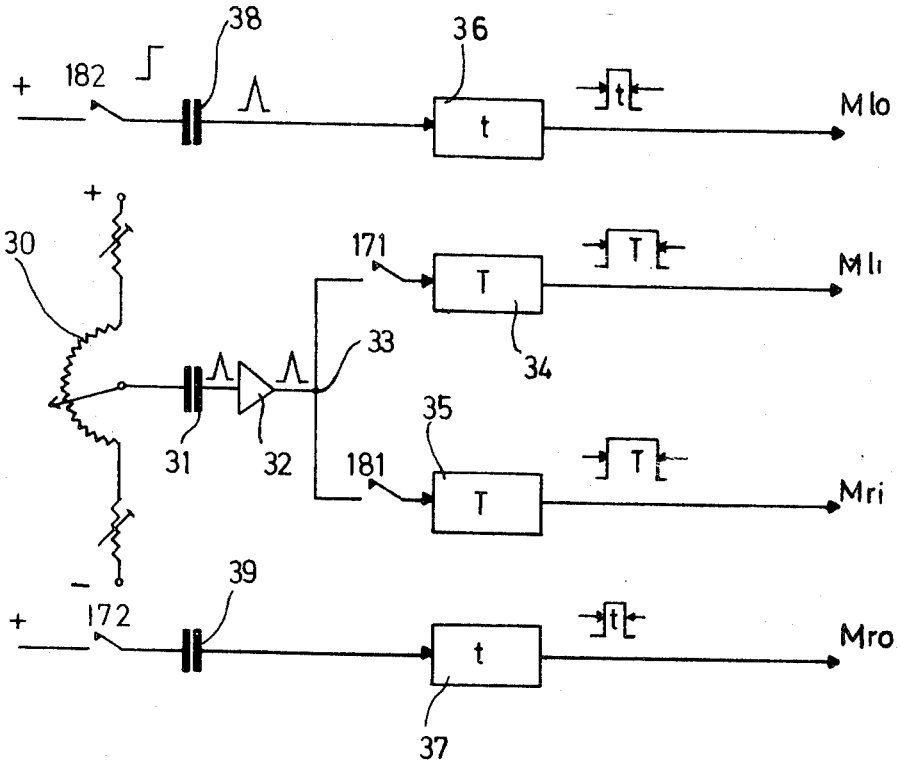
FIG. 4 shows schematically a circuit diagram of the apparatus.

Thus, as the winding operation proceeds the end trips move further and further apart. This eventually results in an accumulation of wire (as shown in FIG. 3*a*) where the end trips are positioned further apart than required. As wire is fed onto the accumulation, the tension in the wire 1 increases sharply and arm 28 upon which dancer pulley 2 is mounted dips about axis 29. Arm 28 is connected to a potentiometer 30 and as the pulley dips a signal is sent to amplifier 32. The output signal from the amplifier 32 actuates a timer which transmits a pulse for a given length of time. In order to ensure that the correct end trip is moved inwardly and that only accumulations near the flanges 20 and 21 of the spool are compensated for, switches 171 and 181 are included in the circuit as indicated in FIG. 4 and described in greater detail hereinafter. If a deficiency occurs close to a flange (as shown in FIG. 3*b*) the dancer pulley 2 moves upwardly to take up the reduction in tension. This movement produces a pulse in the opposite sense to the pulse generated when the arm 28 dips and amplifier 32 is so biased that any voltage changes caused by arm 28 rising are not amplified.

Referring now to FIGS. 1 and 4, it will be seen that as the guide approaches its lefthand extremity cam 14 lifts trip 17. Trip 17 closes switches 171 and 172. When switch 172 is closed a pulse is transmitted across capacitor 39 which actuates a timer 37 which may be, for example, a monostable. The timer 37 transmits a pulse of predetermined length to motor 27 which rotates to move carrier 25 to the right by a first predetermined distance, for example, 1 mm in the case of a wire of 0.5 mm diameter. The closure of switch 171 brings the output 33 of amplifier 32 into communication with timer 34. If there is an accumulation of wire adjacent flange 20 the signal generated by the potentiometer is transmitted through capacitor 31, amplified by amplifier 32 and transmitted to timer 34 which generates a pulse which is sent to servo-motor 26 to move carrier 24 toward carrier 25 by a second distance, which is greater than said first distance and which may be, for example, 8 to 10 mm in the same case of a wire of 0.5 mm diameter. Similarly as the guide moves to its rightward extremity, cam 14 lifts trip 18. This closes switches 181 and 182. The closing of switch 182 causes a pulse to pass capacitor 38 and actuate timer 36 which transmits a pulse to servo-motor 26 to move carrier 24 outwardly by a first distance, for example, 1 mm. The closure of switch 181 allows the output 33 of amplifier 32 to be transmitted to timer 35. Thus, if there is an accumulation adjacent the righthand flange 21 of the spool, the arm 28 dips and a pulse is transmitted to timer 35 which then transmits a signal to servo-motor 27 to move carrier 25 toward carrier 24 by the second distance which is, for example, 8 to 10 mm.

It will be noted that movement of the end trips toward one another is only possible when either trip 17 or 18 is lifted. Thus, if the arm 28 dips in response to an irregularity between the flanges 21 and 22, other than immediately adjacent the flanges, the end trips are unmoved.

Whereas each carrier supports two trips, it will be appreciated that each need only carry one trip; for example, trips 16 and 17 could be replaced by a trip which as progressively lifted would initially actuate switches 171 and 172 and subsequently move to a position to actuate both switches 171 and 172 and initiate reversal of motor 12. It is, however, convenient to use two trips since their relative positions can be varied. Thus, in the arrangement shown in FIG. 1, trip 17 is only lifted while the guide moves along the distance indicated by the letter "*d*" in FIG. 3. This distance "*d*" can be varied by moving trip 17 away from trip 16, although both are firmly connected to carrier 24.

While the dancer pulley arrangement is preferred for detecting accumulations, other arrangements can also be used, for example, another suitable arrangement comprises a first small roller which is fixed on the free extremity of a pivotable arm and which bears on the bobbin adjacent a flange and a second small roller which is fixed on the free extremity of another pivotable arm a short distance from the flange. The angular inclination of one arm with respect to the other is measured and if this exceeds a predetermined amount, for example when an accumulation occurs adjacent a flange, it sends out a signal which can be used for actuating a timer. An accumulation of wire adjacent a flange can also be detected by a photo-electric arrangement.

Whereas the end sensors in the preferred embodiment are actuated directly by the guide, the end sensors could be actuated by, for example a photo-electric cell responsive to the position of the wire, or by a pneumatic circuit. The guide itself could, if desired, comprise a helically threaded axle rotatable in one sense to traverse the wire in one direction and rotatable in the other sense to traverse the wire in the other direction.

It was found that for wires of diameter in the range of from 0.3 to 0.6 mm, good results were obtained when the first distance, i.e., the distance moved by one end trip away from the other end trip between successive actuations of the first end trip was between one third and one twentieth the second distance (i.e., the distance moved when an accumulation is sensed), and preferably between one third and one tenth thereof.

What is claimed is:

1. In a wire winding apparatus including means for supporting a flanged spool and winding wire thereon, a wire guide arranged to traverse the wire back and forth lengthwise of the spool in use, a first end sensor associated with the flange at one end of said spool and a second end sensor associated with the flange at the other end of said spool, each of said end sensors being operative to automatically reverse the direction of the operation of the guide at the end of each traverse, the improvement which comprises means for automatically moving each end sensor after each actuation thereof away from the other end sensor by a first distance, means for detecting an accumulation of wire adjacent each flange of the spool, and means for automatically moving the end sensor associated with each of said flanges upon an accumulation being detected adjacent thereto toward the other end sensor by a second distance which is greater than said first distance.

2. Apparatus as claimed in claim 1, wherein said second distance is from 3 to 20 times greater than said first distance.

3. Apparatus as claimed in claim 2, wherein said second distance is from 5 to 10 times greater than said first distance.

4. Apparatus as claimed in claim 1, wherein the means for moving the end sensors includes a pair of servo motors and means for feeding pulses of varied length to actuate said servo motors, the distances moved by the end sensors being controllable by feeding pulses of varied length to said servo-motors.

5. Apparatus as claimed in claim 1, wherein the means for moving each end sensor said first distance is adapted to commence the said movement of one end sensor away from the other end sensor shortly before the reversal of direction of the said guide by the said other end sensor.

6. An apparatus as claimed in claim 1, wherein said means for detecting an accumulation comprises a dancer pulley attached to an arm connected to a potentiometer.

* * * * *